United States Patent [19]

Yu

[11] Patent Number: 4,885,666

[45] Date of Patent: Dec. 5, 1989

[54] TOUCHABLY-OPERATING MINIATURE FLASHLIGHT

[76] Inventor: Chen-Tsung Yu, P. O. Box 10160, Taipei, Taiwan

[21] Appl. No.: 300,911

[22] Filed: Jan. 24, 1989

[51] Int. Cl.[4] ..... F21L 7/00

[52] U.S. Cl. ..... 362/189; 362/200; 362/205

[58] Field of Search ..... 362/189, 200, 202, 204, 362/205, 208

[56] References Cited

U.S. PATENT DOCUMENTS

| | | | |
|---|---|---|---|
| 1,922,801 | 8/1933 | Gillingham | 362/189 |
| 2,019,884 | 11/1935 | Beaumont | 362/189 |
| 3,359,411 | 12/1967 | Schwartz | 362/189 |
| 4,122,510 | 10/1978 | Halliday, Jr. | 362/189 |
| 4,237,527 | 12/1980 | Breedlove | 362/189 |
| 4,242,724 | 12/1980 | Stone | 362/189 |
| 4,319,309 | 3/1982 | Benoit | 362/200 |
| 4,419,718 | 12/1983 | Chabria | 362/189 |
| 4,443,833 | 4/1984 | Fazzina | 362/189 |
| 4,524,409 | 6/1985 | Yakubek | 362/189 |
| 4,628,418 | 12/1986 | Chabria | 362/189 |
| 4,644,451 | 2/1987 | Chabria | 362/189 |

*Primary Examiner*—Stephen F. Husar
*Assistant Examiner*—Richard R. Cole

[57] ABSTRACT

A flashlight includes a housing having at least a battery socket for storing batteries therein, a bulb detachably mounted on an upper portion of the housing, a flexible sleeve jacket outside the housing, and a pair of spring plates connected between a power circuit formed by the batteries, whereby upon a depression on the sleeve against a recess portion of the housing having the two spring plates formed in the recess portion, the two plates are contacted to close the power circuit for lighting the bulb in an easy way.

1 Claim, 3 Drawing Sheets

TOUCHABLY-OPERATING MINIATURE FLASHLIGHT

BACKGROUND OF THE INVENTION

Trosper et al. disclosed in their U.S. Pat. No. 3,878,635 a signalling device, such as the lighting of a bulb, which is actuated by a magnetic switch operated by a pulley system and can be utilized on a fishing rod. If such a signalling bulb is inferentially expected to be controlled by a hand-operating switch substituting the fishing-wire strained pulley system 7, the bulb can then be used as a signalling device. However, such a hand-operating switch must still be rotated or seesawly operated by the user, causing a slow signalling action especially not suitable for an emergency call for help.

The present inventor has found the shortcoming of a conventional bulb used for signalling purpose and invented the present miniature flashlight which is simply operated by touching an outer sleeve jacketed on its housing.

SUMMARY OF THE INVENTION

The object of the present invention is to provide a miniature flashlight having plural batteries fixed in a housing forming a circuit for powering a bulb fixed on a top portion of the housing, a pair of spring contactor plates which are connected in between the bulb circuit and are normally open to disconnect the power for the bulb, and a flexible sleeve jacketed on the housing, whereby upon a depression on the flexible sleeve against a recess portion formed in the housing having the spring contactor plates provided therein, the power circuit is closed to light the bulb for quicker signalling or lighting purposes.

DETAILED DESCRIPTION

Figure 1:
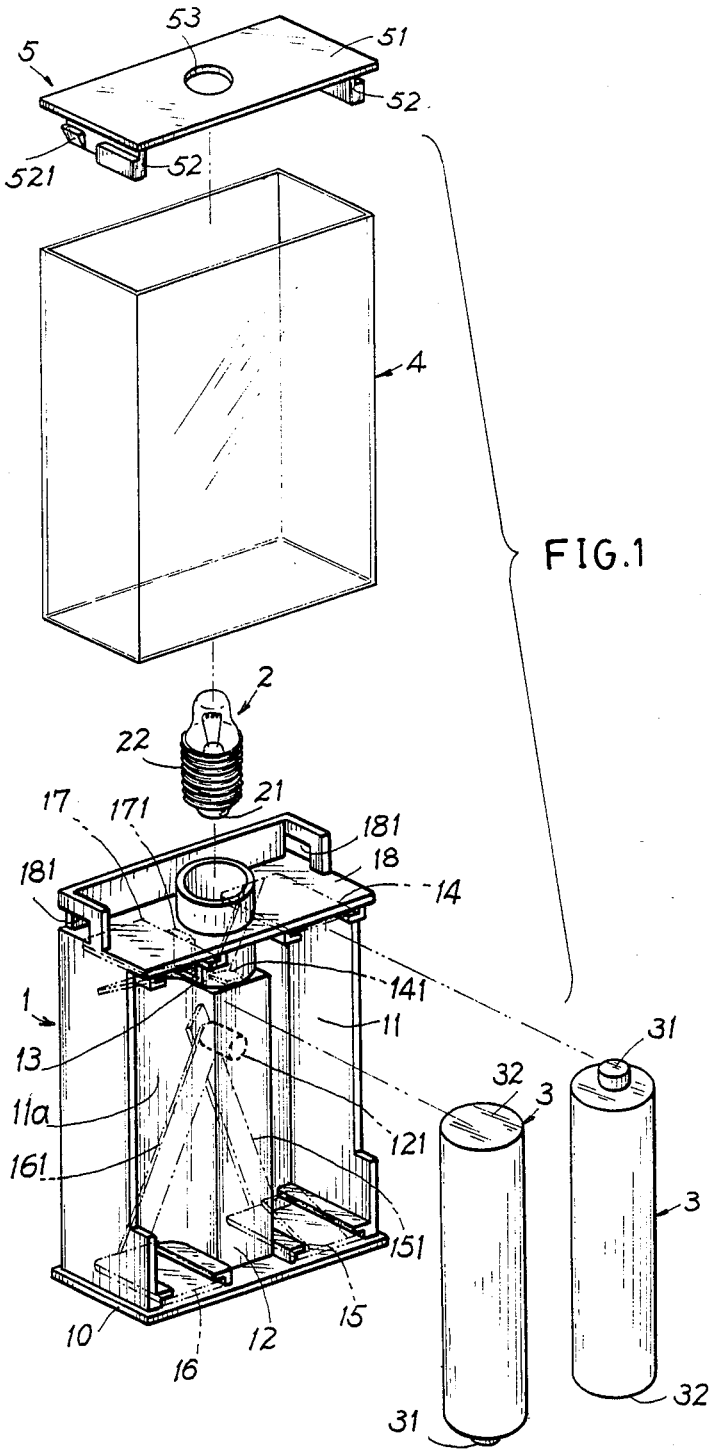
FIG. 1 is a perspective view showing all elements of the present invention.
Figure 2:
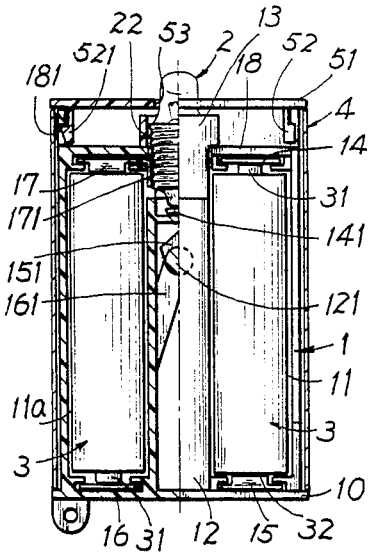
FIG. 2 is a partial sectional front view of the present invention.
Figure 3:
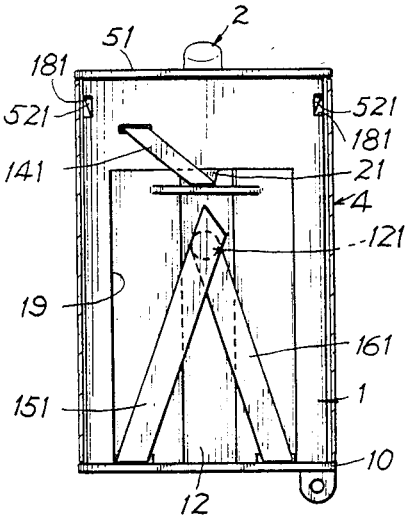
FIG. 3 is a back view of the present invention.

As shown in FIGS. 1–5, the present invention comprises: a housing 1, a bulb 2, two batteries 3, a flexible sleeve 4, and a top cover 5. The housing 1, sleeve 4 and cover 5 are all made of electric insulating materials.

The housing 1 includes: two battery sockets 11, 11*a* for holding the two batteries 3 therein, a central partition plate 12 partitioning the two battery sockets 11, 11*a* having a stem 121 protruding rearwardly from the partition plate 12, a bulb socket 13 formed on a central portion of an upper plate 18 for storing the bulb 2 therein, a bottom plate 10 formed on a bottom of the housing 1, and a recess portion 19 recessed in a rear portion of the housing 1.

A first battery socket 11 is formed in a right portion of the housing 1 having an upper clip 14 formed on its upper portion pertaining a bulb-terminal contactor plate

141 for electrically connecting a bulb terminal 21, and a lower clip 15 formed on a lower portion of the first socket 11 pertaining an outer spring contactor plate 151 protruding rearwardly into the recess portion 19 of the housing 1. The upper and lower clips 14, 15 are all made of electric conductive materials such as aluminum, copper, etc.

Figure 5:
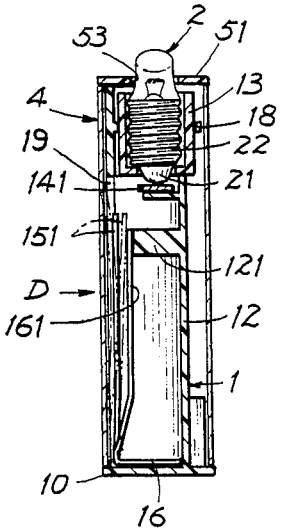
FIG. 5 is a side view sectional drawing of the present invention.

A second battery socket 11*a* is formed in a left portion of the housing 1 having an upper clip 17 formed on its upper portion pertaining a lamp-base contactor plate 171 for electrically connecting a lamp base 22 of the bulb 2, and a lower clip 16 formed on a lower portion of the second socket 11*a* pertaining an inner spring contactor plate 161 operatively contacting the outer plate 151 when depressing the outer plate 151 against the inner plate 161. The outer plate 151 is resiliently separated from the inner plate 161 to be normally open in a power circuit connected between the lamp base 22 and the bulb terminal 21. Both inner and outer plates 161, 151 are located in the recess portion 19 of the housing 1 adapted for a depression (D) by an user's finger as shown in FIG. 5. The two clips 16, 17 are also made of electric conductive materials.

The housing 1 further includes an upper plate 18 formed on an upper portion of the housing having two side holes 181 formed on two opposite sides of the plates 18.

The lamp base 22 of the bulb 2 can be threadedly fixed in the bulb socket 13 and can be detachably replaced with a new bulb once being out of order.

Figure 4:
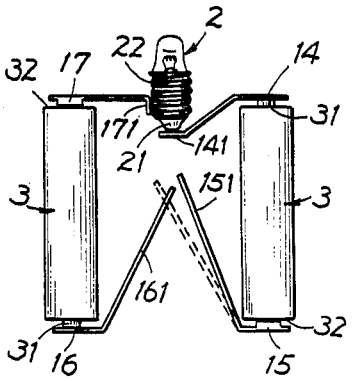
FIG. 4 is an illustration showing a power circuit for the bulb of the present invention.

A first battery 3 is stored in the first socket 11 by contacting the positive terminal 31 with the upper clip 14 and by contacting the negative terminal 32 with the lower clip 15, whereas the second battery 3 is stored in the second socket 11*a* by contacting the positive terminal 31 with the lower clip 16 and contacting the negative terminal 32 with the upper clip 17, thereby forming a power circuit in series for powering the bulb 2 as shown in FIG. 4, which is on-off controlled by the two spring plates 161, 151.

The flexible sleeve 4 is made of flexible elastomers, such as plastic or rubber materials which are electrically insulating.

The top cover 5 includes a horizontal plate 51 having a central hole 53 for protruding the bulb 2 outwardly, and a pair of side plates 52 protruding downwardly from two opposite sides of the plate 51 each side plate 52 having an extension 521 transversely protruding outwardly and operatively engageable with each side hole 181 of the upper plate 18 so that the top cover 5 can be mounted on the upper plate 18 of the housing 1. The top cover 5 may be made of transparent or translucent materials for better illuminating effect by the bulb 2.

After jacketing the sleeve 4 on the housing 1, the top cover 5 is mounted on the housing 1 whereby the horizontal plate 51 and the bottom plate 10 commonly confine the sleeve 4 therebetween. The sleeve 4 is slightly larger than the housing 1 and can be printed with ornamental or advertising features thereon. The shapes of the housing 1, cover 5 and sleeve 4 are not limited in this invention, which can be a rectangular column, a cylindrical or any other suitable shapes.

When using the present invention which is equiped with batteries 3 and bulb 2, the sleeve 4 is depressed to contact the outer spring plate 151 with the inner spring plate 16 to close a power circuit of the bulb 2 as shown in FIGS. 4, 5, in which the power circuit is formed by connecting the bulb terminal 21, the first upper clip 14, the first battery 3, the first lower clip 15, the outer plate 151, the inner plate 161, the second lower clip 16, the second battery 3, the second upper clip 17 and the lamp base 22 of the bulb 2, so as to light the bulb 2. The frequent on-off controls for lighting and switching off the bulb 2 can be conveniently done just by depressing the sleeve 4 on the recess portion 19 of the housing or by releasing the sleeve. The touching operation can be quickly done for signalling purpose.

Figure 6:
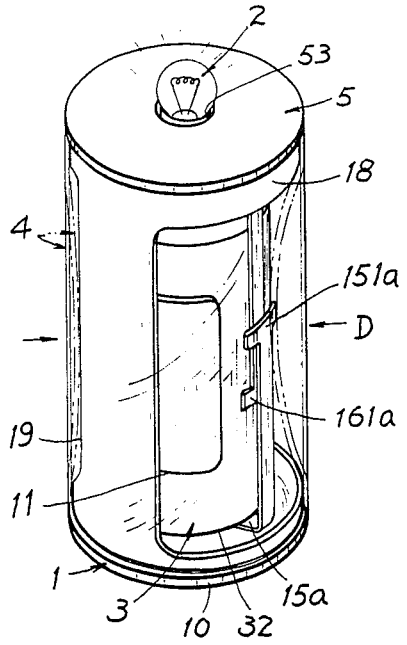
FIG. 6 shows another preferred embodiment of the present invention.
Figure 7:
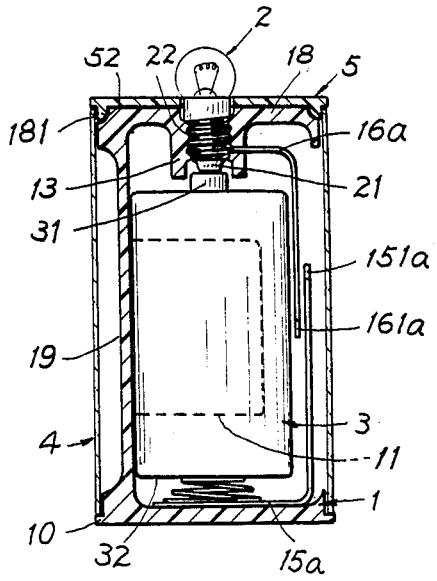
FIG. 7 is a sectional drawing of the present invention as shown in FIG. 6.

Another preferred embodiment of the present invention is shown in FIGS. 6, 7, which comprises: a housing 1 generally shaped as a cylinder having a battery socket 11 for storing a battery 3 therein, a bulb 2 detachably mounted in a bulb socket 13 formed in an upper plate 18 of the housing 1, a cylindrical sleeve 4 jacketed on the housing 1, and a top cover 5 mounted on a top end of the housing 1.

The housing 1 is formed with a recess portion 19 recessed from an upper plate 18 and a bottom plate 10 adapted for an user's depression D thereon. An upper clip 16*a* is connected to a lamp base 22 of the bulb 2 through the socket 13 having an inner spring contactor plate 161*a*. A lower clip 15*a* is connected to a negative terminal 32 of the battery 3 at the bottom plate 10 having an outer spring contactor plate 151*a* operatively contacting the inner plate 161*a* upon a depression on the outer plate 151*a*. The positive terminal 31 of the battery 3 is contacted with the bulb terminal 21. The top cover 5 is formed with an annular extension 52 thereunder engageable with an annular groove 181 formed in the upper plate 18 so that the top cover 5 can be mounted on the housing 1 to confine the sleeve 4 between the top cover 5 and the bottom plate 10. By depressing (D) the sleeve 4 on the recess portion 19 of the housing 1, the two plates 151*a*, 161*a* are contacted to close the power circuit of the bulb 2 for lighting the bulb, in which the circuit includes the bulb terminal 21, the positive terminal 31 of battery 3, the negative terminal 32 of battery, the lower clip 15*a*, the outer plate 151*a*, the inner plate 161*a*, the upper clip 16*a* and the lamp base 22 of the bulb 2.

The present invention has the following advantages superior to a conventional flash light:

1. Just depressing the housing of the light, it can be quickly lighted. Once releasing the housing, the light will instantly be switched off. It can be effiently served as a lighting or signalling device.

2. By dismantling the top cover 5, the bulb 2 or batteries 3 can be easily replaced with new one.

3. The components or elements forming the light are not complex and can be produced with lower cost and can be maintained easily.

I claim:

1. A miniature flashlight comprising:

a housing having two battery sockets disposed on a right and a left sides of the housing, a bottom plate formed on a bottom of the housing, an upper plate formed on an upper portion of the housing having a bulb socket formed in a central portion of the upper plate and a recess portion formed in a rear portion of said housing opposite to said two battery sockets;

a bulb detachably mounted in said bulb socket of said housing; two batteries respectively held in said two battery sockets in said housing and electrically connected in series for forming a power circuit between a bulb terminal and a lamp base of the bulb for lighting said bulb;

two spring contactor plates normally resiliently open and operatively closed forming a part of said power circuit of said bulb for lighting said bulb;

a flexible sleeve jacketed on said housing; and a top cover mounted on said upper plate confining said sleeve between said top cover and said bottom plate, said top cover including a horizontal plate having a central hole for protruding said bulb outwardly, a pair of side plates protruding downwardly from two opposite sides of said horizontal plate each side plate having an extension engageable with a side hole formed in said upper plate of said housing so that said top cover can be mounted on said housing; said housing, said sleeve and said top cover being made of electrical insulating materials, whereby upon a depression of the sleeve on the recess portion, said two spring contactor plates are contacted to close the power circuit for lighting said bulb;

the improvement which comprises: said housing including a first battery socket having a first upper clip formed on an upper portion of the battery socket under the upper plate pertaining a bulb-terminal contactor plate for electrically connecting a bulb terminal, and a first lower clip formed on a lower portion of the battery socket on the bottom plate pertaining an outer spring contactor plate protruding rearwardly into said recess portion of said housing, said first battery socket having a first battery held therein with a positive terminal of the first battery contacting the first upper clip and a negative terminal of the first battery contacting the first lower clip; and a second battery socket having a second upper clip formed on its upper portion pertaining a lamp-base contactor plate electrically connecting a lamp base of said bulb, and a second lower clip formed on a lower portion of the second battery socket pertaining an inner spring contactor plate protruding rearwardly into the recess portion of said housing to be fixed on a stem protruding rearwardly from a central partition plate separating the two battery sockets so as to be operatively contacted by said outer spring contactor plate to close the power circuit for lighting said bulb, a second battery held in said second battery socket having a postive terminal of the second battery contacting said second lower clip and having a negative terminal of the battery contacting said second upper clip.

* * * * *